US009243193B2

(12) United States Patent
Brown et al.

(10) Patent No.: US 9,243,193 B2
(45) Date of Patent: Jan. 26, 2016

(54) FIXED BED HYDROVISBREAKING OF HEAVY HYDROCARBON OILS

(71) Applicant: ExxonMobil Research and Engineering Company, Annandale, NJ (US)

(72) Inventors: Stephen H. Brown, Annandale, NJ (US); Stephen Mark Davis, Humble, TX (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 201 days.

(21) Appl. No.: 13/803,253

(22) Filed: Mar. 14, 2013

(65) Prior Publication Data

US 2014/0262947 A1 Sep. 18, 2014

(51) Int. Cl.

| | |
|---|---|
| ***C10G 47/00*** | (2006.01) |
| ***C10G 47/02*** | (2006.01) |
| ***C10G 7/00*** | (2006.01) |
| ***C10G 49/00*** | (2006.01) |
| ***C10G 9/00*** | (2006.01) |

(Continued)

(52) U.S. Cl.

CPC *C10G 47/02* (2013.01); *C10G 7/00* (2013.01); *C10G 9/007* (2013.01); *C10G 47/00* (2013.01); *C10G 49/002* (2013.01)

(58) Field of Classification Search

CPC ..... C10G 47/02; C10G 47/04; C10G 47/06; C10G 47/10; C10G 47/12; C10G 47/16; C10G 47/32

USPC ..... 208/81–82, 100, 106–112

See application file for complete search history.

(56) References Cited

U.S. PATENT DOCUMENTS

| | | | |
|---|---|---|---|
| 3,617,525 | A | 11/1971 | Moritz et al. |
| 4,302,323 | A | 11/1981 | Chen |

(Continued)

FOREIGN PATENT DOCUMENTS

| | | | |
|---|---|---|---|
| DE | 4308507 | A1 | 9/1993 |
| EP | 0040018 | A2 | 11/1981 |

(Continued)

OTHER PUBLICATIONS

PCT Application No. PCT/US2014/017905, Communication from the International Searching Authority, Form PCT/ISA/206, dated May 8, 2014, 7 pages.

(Continued)

*Primary Examiner* — Brian McCaig

(74) *Attorney, Agent, or Firm* — Robert A. Migliorini; Chad A. Guice

(57) ABSTRACT

The disclosure relates to processes for upgrading heavy hydrocarbon oils such as heavy crude oils, atmospheric residuum, vacuum residuum, heavy oils from catalytic treatment, heavy cycle oils from fluid catalytic cracking, thermal tars, as oils from visbreaking, oils from oil sands, bitumen, deasphlter rock, and heavy oils derived from coal. The process utilizes a utility fluid including recycled liquid hydroprocessed product containing a significant amount of single or multi-ring aromatics. Unlike conventional fixed bed resid hydroprocessing, the process can be operated at temperatures pressures and reactor conditions that favor the desired hydrocracking reactions over aromatics hydrogenation reduce the coking tendencies of heavy hydrocarbon oils.

14 Claims, 1 Drawing Sheet

(51) Int. Cl.

| | |
|---|---|
| *C10G 47/04* | (2006.01) |
| *C10G 47/06* | (2006.01) |
| *C10G 47/10* | (2006.01) |
| *C10G 47/12* | (2006.01) |
| *C10G 47/16* | (2006.01) |
| *C10G 47/32* | (2006.01) |

(56) References Cited

U.S. PATENT DOCUMENTS

| | | | | |
|---|---|---|---|---|
| 4,414,095 | A * | 11/1983 | Dickakian | C10C 3/00 208/44 |
| 4,421,633 | A | 12/1983 | Shih et al. | |
| 4,708,788 | A * | 11/1987 | Low | C10G 1/042 208/107 |
| 4,846,958 | A | 7/1989 | Feldman et al. | |
| 4,857,168 | A * | 8/1989 | Kubo et al. | 208/58 |
| 5,069,775 | A | 12/1991 | Grosboll | |
| 5,370,787 | A | 12/1994 | Forbus, Jr. | |
| 2010/0326887 | A1 | 12/2010 | McGehee et al. | |
| 2011/0005970 | A1 | 1/2011 | Ou et al. | |

FOREIGN PATENT DOCUMENTS

| | | | |
|---|---|---|---|
| GB | 2194794 | A | 3/1988 |
| WO | 2013033288 | A2 | 3/2013 |
| WO | 2013033298 | A2 | 3/2013 |
| WO | 2013033575 | A1 | 3/2013 |
| WO | 2013033590 | A2 | 3/2013 |

OTHER PUBLICATIONS

PCT Application No. PCT/US2014/017905, Communication from the International Searching Authority, Forms PCT/ISA/220 and PCT/ISA/237, dated Jan. 26, 2015, 23 pgs.

U.S. Appl. No. 13/601,250, filed Aug. 31, 2012 by ExxonMobil Chemical Co.

* cited by examiner

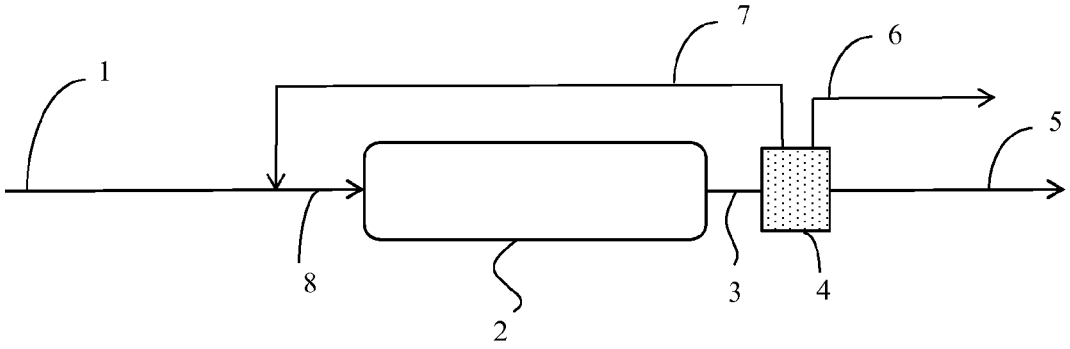
7
6
1
5
8
2
3
4

FIXED BED HYDROVISBREAKING OF HEAVY HYDROCARBON OILS

FIELD

The disclosure relates to a Fixed Bed Hydrovisbreaking processes for upgrading heavy hydrocarbon oils such as bitumen, resids and tars.

BACKGROUND

Refiners have had a continuing need to create useable products from a variety of heavy hydrocarbon oils. Particularly, there is an increasing need to produce more fuel and less byproducts from heavy oils with relatively high amounts of 1050° F.+ (565° C.+), heteroatoms, aromatic carbon, metals (such as Ni, V, and Fe), and asphaltenes (pentane and/or heptane insoluble). A common upgrading technique used today is coking, which downgrades substantial quantities of heavy oil into solid coke and C4− gas. For example, typical Canadian bitumen upgrading by coking produces 18 wt. % coke and 10 wt. % C4− gas. The process of the disclosure has the potential to produce <1 wt. % coke and <5 wt. % C4− gas. The process of the disclosure reduces environmental burden by concentrating the metals from the heavy hydrocarbon oil onto spent catalysts and producing solid sulfur as a byproduct which can be disposed of in a safe manor as opposed to being burnt and released into the air as SOx.

Crude oil is typically distilled to produce a variety of components that can be used directly as fuels or that are used as feedstocks for further processing or upgrading. In what is known as atmospheric distillation, a heavy residuum is produced typically that has an initial boiling point of 650° F. (343° C.). This residuum is typically referred to as atmospheric residuum or as an atmospheric residuum fraction.

Atmospheric residuum fractions tend to collect a relatively high quantity of various metals, sulfur components and nitrogen components relative to the lighter distillation fractions as a result of the distillation process. Because these metal, sulfur and nitrogen components are relatively undesirable in various fuels, they are typically removed by various catalytic hydroprocessing techniques.

In many instances, the atmospheric residuum is further distilled under vacuum, i.e., at a pressure below atmospheric pressure, to recover additional distillation fractions. At vacuum conditions, additional lighter fractions can be recovered without adding to various problems encountered in atmospheric distillation such as coking of the heavy fraction components. The heavy residuum recovered in vacuum distillation of the atmospheric residuum is typically referred to as vacuum residuum or a vacuum residuum fraction, and typically has an initial boiling point of 1050° F. (566° C.). This vacuum residuum is generally higher in metals, sulfur components and nitrogen components than atmospheric residuum, and as in the case with atmospheric residuum, removal of these components is typically carried out by catalytic hydroprocessing.

Catalytic hydroprocessing of atmospheric and vacuum residua is carried out in the presence of hydrogen, using a hydroprocessing catalyst. In some processes, hydroprocessing of residua is carried out by adding a diluent or solvent.

Another source of heavy hydrocarbon oils of interest is extracted from oil sands such as Athabasca and Cold Lake oil sands in Canada. Typically, such heavy hydrocarbon oils have an initial boiling point of 200-500° F. (93-260° C.), a specific gravity greater than 1, and also have very high viscosities, which can exceed 5,000 centipoise at 40° C. Such high viscosities inhibit the ability to even pump these materials.

U.S. Pat. No. 3,617,525 discloses a process for removing sulfur from a hydrocarbon fraction having a boiling point above 650° F. (343° C.). In carrying out the process, the hydrocarbon fraction is separated into a gas oil fraction having a boiling point between 650° F. (343° C.) and 1050° F. (566° C.), and a heavy residuum fraction boiling above 1050° F. (566° C.). The gas oil fraction is catalytically hydrodesulfurized until the gas oil fraction contains less than 1 percent sulfur. The hydrodesulfurized gas oil is then used to dilute the heavy residuum fraction, and the diluted heavy residuum fraction is catalytically hydrodesulfurized, producing fuels or fuel blending components reduced in sulfur content. The process is considered to provide an increased catalyst life and to use a smaller reactor volume compared to typical processes.

U.S. Pat. No. 4,302,323 discloses a process for upgrading a residual petroleum fraction in which the residual fraction is mixed with a light cycle oil and hydrogen and the mixture sent through a catalytic hydrotreating zone containing a hydrotreating catalyst and then a hydrocracking zone containing a hydrocracking catalyst. Upgraded products are then separated from the effluent of the hydrocracking zone. The light cycle oil boils in the range of from 400° F. (204° C.) to 700° F. (371° C.), has a high aromatic content, and is high in nitrogen. It is considered that the light cycle oil acts more as a diluent rather than as a hydrogen donor and that the addition of the light cycle oil resulted in a substantial increase in the yield of premium products such as distillate fuels.

U.S. Pat. No. 4,421,633 discloses a combination hydrodesulfurization and hydrocracking process. The feedstock can be atmospheric residuum or vacuum residuum, which is mixed with a solvent that is a recycled distillate boiling at 400° F.-700° F. (204° C.-371° C.), considered to be equivalent to a FCC light cycle oil. The process uses a mixture of large pore and small pore catalysts such as large and small pore sulfided Ni—W catalysts. The process converts the higher boiling point residua to lower boiling point hydrocarbons by forming distillate and naphtha while removing heteroatoms, metal and carbon residuals from the higher boiling point residua.

There is a need to further develop processes for hydroprocessing heavy hydrocarbon oils to produce fuel grade products that meet pipeline specifications. It is also particularly desirable to provide hydroprocessing processes with improved selectivity to desired products. For example, it is desirable to provide hydroprocessing processes that crack molecules boiling at or above 1050° F. (566° C.) (also referred to as a "1050° F.+ (566° C.+) fraction" herein) into molecules boiling below 1050° F. (566° C.) (also referred to as a "1050° F.− (566° C.−) fraction" herein), while minimizing the formation of C4− hydrocarbon compounds (i.e., hydrocarbon compounds having four carbons or less), and coke byproducts.

SUMMARY

In one form of the present disclosure, a hydrocarbon conversion process comprises the steps of: (a) providing a heavy hydrocarbon oil wherein the heavy hydrocarbon oil comprises molecules having an ASTM D86 initial boiling point of ≥300° C.; (b) providing a utility fluid, the utility fluid comprising ≥20.0 wt. % aromatic carbon based on the weight of the utility fluid; (c) exposing at least a portion of the heavy hydrocarbon oil to at least one hydroprocessing catalyst under catalytic hydroprocessing conditions in the presence of molecular hydrogen and the utility fluid at a utility fluid:

heavy hydrocarbon weight ratio in the range of 0.05 to 20.0 to produce a hydroprocessed product; and (d) separating a liquid phase from the hydroprocessed product, the liquid phase comprising ≥90.0 wt. % of the hydroprocessed product's molecules having at least four carbon atoms based on the weight of the hydroprocessed product wherein the utility fluid comprises the liquid phase in an amount ≥90.0 wt. % based on the weight of the utility fluid.

In another form of the present disclosure, a hydrocarbon conversion process, comprises the steps of: (a) providing a heavy hydrocarbon oil comprising molecules having an ASTM D86 initial boiling point of ≥300° C.; (b) providing a utility fluid, the utility fluid comprising ≥20.0 wt. % aromatic carbon measured by NMR based on the weight of the utility fluid; (c) exposing at least a portion of the heavy hydrocarbon oil to at least one hydroprocessing catalyst under catalytic hydroprocessing conditions in the presence of molecular hydrogen and the utility fluid at a utility fluid:heavy hydrocarbon oil weight ratio in the range of 0.05 to 20.0 to produce a hydroprocessed product; (d) separating a liquid phase from the hydroprocessed product, the liquid phase comprising ≥90.0 wt. % of the hydroprocessed product's molecules having at least four carbon atoms based on the weight of the hydroprocessed product; and (e) separating from the liquid phase a light liquid and a heavy liquid, wherein the heavy liquid comprises 90 wt. % of the liquid phase's molecules having an atmospheric boiling point of ≥300° C.; wherein the utility fluid comprises a portion of the separated light liquid in an amount ≥10.0 wt. % based on the weight of the utility fluid and the remainder of the utility fluid comprises a portion of the heavy liquid.

In yet another form of the present disclosure, a continuous hydrocarbon conversion process comprises the steps of: (a) providing a heavy hydrocarbon oil comprising molecules having an ASTM D86 initial boiling point of ≥300° C.; (b) providing a utility fluid, the utility fluid comprising ≥20.0 wt. % aromatic carbon measured by NMR based on the weight of the utility fluid; (c) exposing ≥50.0 wt. % of the heavy hydrocarbon oil based on the weight of the second mixture's heavy hydrocarbon to at least one hydroprocessing catalyst under catalytic hydroprocessing conditions operating continuously for a time ≥24 hours, in the presence of the utility fluid and 50.0 $sm^3/m^3$ to 500.0 $sm^3/m^3$ molecular hydrogen at (i) an LHSV in the range of from 1.0 to 40.0 $hr^{-1}$, (ii) a temperature in the range of 300.0° C. to 500.0° C., (iii) a pressure in the range of from 25 bar (absolute) to 75 bar (absolute), and (iv) a utility fluid:heavy hydrocarbon oil weight ratio in the range of 0.05 to 20.0, to produce a hydroprocessed product; and (d) separating a liquid phase from the hydroprocessed product, the liquid phase comprising ≥95.0 wt. % of the hydroprocessed product's molecules having at least four carbon atoms based on the weight of the hydroprocessed product; wherein the utility fluid comprises the separated liquid phase in an amount ≥99.0 wt. % based on the weight of the utility fluid.

BRIEF DESCRIPTION OF THE FIGURE

The FIGURE schematically illustrates an embodiment of the disclosure where a separation stage is utilized downstream of a hydroprocessing stage to separate and recycle a portion of the reactor effluent's total liquid product for use as a utility fluid.

DETAILED DESCRIPTION

All numerical values within the detailed description and the claims herein are modified by "about" or "approximately" the indicated value, and take into account experimental error and variations that would be expected by a person having ordinary skill in the art.

The inventors have discovered conditions that enable hydrovisbreaking in a fixed bed of heavy hydrocarbon oils such as tar bitumen, crude oil, atmospheric or vacuum residuum. Hydrovisbreaking (a subset of hydroconversion) uses hydrogen to reduce the viscosity and convert a substantial amount high boiling materials to lower boiling materials while limiting the hydrogenation of the aromatic species. Hydrovisbreaking typically is carried out in fixed catalyst bed hydroprocessing units operating at less than 1500 psig and temperatures of between 715° F. (380° C.) and 840° F. (450° C.). Visbreaking is the thermal process carried out without hydrogenation.

Those skilled in the art expect to form toluene insolubles and coke when hydroprocessing or hydrovisbreaking atmospheric or vacuum residua or other heavy hydrocarbon oils to 1050° F.+ (566° C.+) at conversions between 25 and 55%. Coke and toluene insolubles are known to plug channels in packed beds, plate and frame heat exchangers, and honeycombs. Visbreaking or hydrovisbreaking are not generally practiced in devices with small channels that are prone to coking. Special conditions are required to achieve stable operation (<1000 ppm coke selectivity based on heavy hydrocarbon oil converted) in packed beds and other equipment with similar channel sizes. The inventors discovered that the required conditions include high mass velocity operation, substantial dilution of the heavy hydrocarbon oil with recycled liquid product and 0 to 50% distillate boiling range (130-350° C.) aromatic molecules, medium pressure operation (500 to 1500 psig).

The hydrovisbreaking hydroprocessing process of the disclosure achieves better selectivity than typical results reported in the hydrovisbreaking literature. Hydrogen consumption is low because there is minimal aromatics saturation. Secondary reactions of primary cracking products are minimized resulting in less C4− and naphtha compared to prior efforts.

There is a need to control fouling and incompatibility during heavy hydrocarbon oil processing. Control of incompatibility allows high conversion of heavy hydrocarbon oils to clean fuels. Most commercial processes where the feed is comprised of greater than 10% heavy hydrocarbon oils are limited by incompatibility.

Incompatibility is managed by limiting conversion and or hydrogenating polynuclear aromatics faster than they can convert to incompatible molecules. The problem with the hydrogenation approach is that unselective hydrogenation reduces the solvency of the bulk fluid for aromatics. Hydrogenating ordinary aromatics that are not coke precursors increases incompatibility by reducing the solvency of the composition. While not wishing to be bound by any theory, the inventors believe that at the conditions of the disclosure, aromatics hydrogenation is surprisingly more selective for coke precursors than for ordinary feed and product aromatic molecules. The inventors believe that reaching relatively high conversion levels using less hydrogen consumption is necessary although not sufficient for preventing coking.

Conventional upgrading processes involving conventional catalytic hydroprocessing suffer from significant catalyst deactivation by coking. Deactivation by coking means that hydrogen stripping and solvent washing at or below the reaction temperature and pressure will not restore the catalyst activity. In practice, combustion is used to remove the carbonaceous deposits and restore near fresh hydrotreating catalyst activity. The process can be operated at a temperature in the range of from 350° C. to 410° C., at a pressure in the range of 5400 kPa to 20,500 kPa, using catalysts containing one or more of Co, Ni, or Mo; but significant catalyst coking is observed.

The disclosure is based in part on the discovery that catalyst coking can be lessened by hydroprocessing oil sands, bitumens, whole heavy oils, heavy oil atmospheric resid, heavy oil, atmospheric resids, vacuum resids, and deasphalter rocks in the presence of a utility fluid comprising a significant amount of single or multi-ring aromatics. Unlike conventional processes, the process can be operated at temperatures and pressures that favor the desired hydrocracking reaction over aromatics hydrogenation. It has been discovered that recycled liquid hydroprocessed product according to the disclosure makes an outstanding utility fluid.

This disclosure provides a process for producing a hydroprocessed product. The process is capable of treating heavy hydrocarbon oils to produce a hydroprocessed oil product that has reduced sulfur, nitrogen, metals and 1050° F.+ (566° C.+) components (i.e., components that boil at 1050° F. (566° C.) and above) relative to the heavy oil.

The disclosure is particularly advantageous in that substantially longer run length can be achieved relative to conventional hydroprocessing methods. This benefit can be enhanced by operating at relatively high temperature, high LHSV, and relatively low hydrogen partial pressure. Operation at desired temperature and pressure is carried out using a particular utility fluid as a co-feed component. In particular, the utility fluid contains recycled liquid product of the hydroprocessing.

Heavy Hydrocarbon Oil

The hydroprocessed product is produced from a heavy hydrocarbon oil component. Examples of heavy hydrocarbon oils include, but are not limited to, heavy crude oils, atmospheric residuum, vacuum residuum, heavy oils coming from catalytic treatment (such as heavy cycle oils from fluid catalytic cracking), thermal tars (such as oils from visbreaking or similar thermal processes), oils from oil sands (such as bitumen) deasphalter rock, and heavy oils derived from coal.

Heavy hydrocarbon oils can be liquid, semi-solid, and/or solid. Additional examples of particular heavy oils that can be hydroprocessed, treated or upgraded according to this disclosure include Athabasca bitumen, whole crude, atmospheric, and vacuum residuum from Brazilian Santos and Campos basins, Egyptian Gulf of Suez, Chad, Venezuelan Zulia, Malaysia, and Indonesia Sumatra.

The heavy hydrocarbon oil will have an initial ASTM D86 boiling point of 570° F. (300° C.) or greater or an initial ASTM D86 boiling point of 650° F. (343° C.) or greater. The heavy hydrocarbon oil will have an ASTM D86 10% distillation point of at least 650° F. (343° C.), alternatively at least 660° F. (349° C.) or at least 750° F. (399° C.), or at least 1020° F. (549° C.). The heavy hydrocarbon oil will have a 1050° F.+ (566° C.+) content of greater than 33 wt. % by ASTM D86 or a 1050° F.+ (566° C.+) content of greater than 25 wt. %.

The heavy hydrocarbon oil will have a relatively high heteroatom (sulfur, nitrogen and oxygen) content compared to other petroleum materials. Specifically the heavy hydrocarbon oil will have, greater than 2 wt. % heteroatoms (S+N+O), or greater than 1.5 wt. % heteroatoms.

The heavy hydrocarbon oil will have a relatively high aromatic content. The carbon aromaticity or aromatic carbon $C_A$ (the percent of the total carbon atoms that are aromatic) is measured by $^{13}C$ Nuclear Magnetic Resonance ("NMR"). The heavy hydrocarbon oil will have greater than 20% $C_A$, or greater than 15% $C_A$.

For example the heavy hydrocarbon oil Athabasca bitumen is typically 40 wt. % 1050° F.+ (566° C.+) by ASTM D86, contains 5 wt. % heteroatoms (S+N+O) and has 25% $C_A$.

Heavy hydrocarbon oils can be relatively high in total acid number (TAN). For example, heavy hydrocarbon oils that can be hydroprocessed according to this disclosure have a TAN of at least 0.1, at least 0.3, or at least 1.

Density, or weight per volume, of the heavy hydrocarbon oil can be determined according to ASTM D287-92 (2006) Standard Test Method for API Gravity of Crude Petroleum and Petroleum Products (Hydrometer Method), and is provided in terms of API gravity. In general, the higher the API gravity, the less dense the oil. API gravity is at most 20° in one embodiment, at least 15° in another embodiment, and at least 10° in another embodiment.

Heavy hydrocarbon oils can be high in metals, depending heavily on the source of the heavy hydrocarbon oil. For example, the heavy hydrocarbon oil can be high in total nickel, vanadium and iron contents. In one embodiment, the heavy hydrocarbon oil will contain at least 0.00005 grams of Ni/V/Fe (50 ppm) or at least 0.0002 grams of Ni/V/Fe (200 ppm) per gram of heavy hydrocarbon oil, on a total elemental basis of nickel, vanadium and iron.

The disclosure is particularly suited to treating heavy hydrocarbon oils containing at least 500 parts per million by weight (wppm) elemental sulfur, based on total weight of the heavy hydrocarbon oil. Generally, the sulfur content of such heavy hydrocarbon oils can range from 500 wppm to 100,000 wppm elemental sulfur or from 1000 wppm to 50,000 wppm or from 1000 wppm to 30,000 wppm, based on total weight of the heavy hydrocarbon component. Sulfur will usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, di- and polysulfides.

It has been observed that heavy hydrocarbon oils comprise a significant amount of asphaltenes. Specifically, heavy hydrocarbon oils can be high in n-pentane asphaltenes and high in n-heptane insoluble asphaltenes. In two embodiments, the heavy hydrocarbon oil will contain at least 5 wt. % or at least 15 wt. % n-pentane insoluble asphaltenes. The heavy hydrocarbon oils can have a kinematic viscosity at 50° C. in the range of 200 cSt to $1.0\times10^7$ cSt.

Hydroprocessing of the heavy hydrocarbon oil takes place in the presence of a utility fluid, the utility fluid comprising recycled liquid hydroprocessed product. Utility fluids useful in the disclosure will now be described in more detail.

Utility Fluid

The utility fluid is utilized in hydroprocessing the heavy hydrocarbon oil, e.g., for effectively increasing run-length during hydroprocessing and improving the properties of the hydroprocessed product. Effective utility fluids comprise aromatics, i.e., comprise molecules having at least one aromatic core. In one or more embodiments, the utility fluid comprises ≥20.0 wt. % aromatic carbon such as ≥30.0 wt. % aromatic carbon as measured by $^{13}C$ NMR.

The utility fluid comprises a portion of the liquid phase of the hydroprocessed product, effectively being recycled back to the hydroprocessor. For example, the utility fluid can comprise ≥50.0 wt. % of the liquid phase, such as ≥75.0 wt. %, or ≥95.0 wt. %, or even ≥99.0 wt. % based on the weight of the utility fluid. The remainder of the liquid phase of the hydroprocessed product may be conducted away from the process and optionally used as a low sulfur fuel oil blend component.

The hydroprocessed product may optionally pass through one or more separation stages. Non-limiting examples of the separation stages may include: flash drums, distillation columns, evaporators, strippers, steam strippers, vacuum flashes, or vacuum distillation columns. These separation stages allow one skilled in the art to adjust the properties of the liquid phase to be used as the utility fluid. The liquid phase of the hydroprocessed product may comprise ≥90.0 wt. % of the hydroprocessed product's molecules having at least four carbon atoms based on the weight of the hydroprocessed product. In other embodiments, the liquid phase comprises ≥90.0 wt. % of the hydroprocessed product's molecules based on the weight of the hydroprocessed product having an atmospheric boiling point ≥65.0° C., ≥150.0° C., ≥260.0° C.

In other embodiments, the total liquid phase of the hydroprocessed product is separated into a light liquid and a heavy liquid where the heavy liquid comprises 90 wt. % of the molecules with an atmospheric boiling point of ≥300° C. that were present in the liquid phase. The utility fluid comprises a portion of the light liquid obtained from this separation.

Optionally, in other embodiments, the utility fluid that comprises at least a portion of the liquid phase of the hydroprocessed product can be augmented by supplemental utility fluids that have an ASTM D86 10% distillation point ≥120° C., e.g., ≥140° C., such as ≥150° C. and/or an ASTM D86 90% distillation point ≤300° C. In one embodiment the supplemental utility fluid is a kerosene fraction of the liquid product with an ASTM D86 10% distillation point of 200° C., and an ASTM D86 90% distillation point of 250° C. This option can also be especially useful during start-up or periods of unit upsets or other operability problems, such as for example when the heavy hydrocarbon oil quality changes.

The supplemental utility fluid can be a solvent or mixture of solvents. In one or more embodiments, the supplemental utility fluid (i) has a critical temperature in the range of 285° C. to 400° C. and (ii) comprises ≥80.0 wt. % of 1-ring aromatics and/or 2-ring aromatics, including alkyl-functionalized derivatives thereof, based on the weight of the supplemental utility fluid. For example, the supplemental utility fluid can comprise, e.g., ≥90.0 wt. % of a single-ring aromatic, including those having one or more hydrocarbon substituents, such as from 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different. Optionally, the supplemental utility fluid comprises ≥90.0 wt. % based on the weight of the utility fluid of one or more of benzene, ethylbenzene, trimethylbenzene, xylenes, toluene, naphthalenes, alkylnaphthalenes (e.g., methylnaphthalenes), tetralins, or alkyltetralins (e.g., methyltetralins). It is generally desirable for the supplemental utility fluid to be substantially free of molecules having alkenyl functionality, particularly in embodiments utilizing a hydroprocessing catalyst having a tendency for coke formation in the presence of such molecules. In an embodiment, the supplemental utility fluid comprises ≤10.0 wt. % of ring compounds with $C_1$-$C_6$ sidechains having alkenyl functionality, based on the weight of the utility fluid.

Generally, the supplemental utility fluid contains sufficient amount of molecules having one or more aromatic cores to augment the utility fluid that comprises recycled hydroprocessed product to effectively increase run length during hydroprocessing of the heavy hydrocarbon oil. For example, the supplemental utility fluid can comprise ≥50.0 wt. % of molecules having at least one aromatic core, e.g., ≥60.0 wt. %, such as ≥70 wt. %, based on the total weight of the utility fluid. In an embodiment, the supplemental utility fluid comprises (i) ≥60.0 wt. % of molecules having at least one aromatic core and (ii) ≤1.0 wt. % of ring compounds with $C_1$-$C_6$ sidechains having alkenyl functionality, the weight percents being based on the weight of the utility fluid.

The relative amounts of utility fluid and heavy hydrocarbon oil during hydroprocessing are generally in the range of from 5.0 wt. % to 95.0 wt. % of the heavy hydrocarbon oil and from 5.0 wt. % to 95 wt. % of the utility fluid, based on total weight of utility fluid plus heavy hydrocarbon oil. The utility fluid:heavy hydrocarbon weight ratio can be in the range of 0.05 to 20.0. In other embodiments in the utility fluid:heavy hydrocarbon weight ratio can be in the range of 0.10 to 2.0. At least a portion of the utility fluid can be combined with at least a portion of the heavy hydrocarbon oil within the hydroprocessing vessel or hydroprocessing zone, but this is not required, and in one or more embodiments at least a portion of the utility fluid and at least a portion of the heavy hydrocarbon oil are supplied as separate streams and combined into one feed stream prior to entering (e.g., upstream of) the hydroprocessing vessel or hydroprocessing zone.

Hydrogen Stream

Hydroprocessing is carried out in the presence of molecular hydrogen. A hydrogen stream is, therefore, fed or injected into a vessel or reaction zone or hydroprocessing zone in which the hydroprocessing catalyst is located.

Hydrogen, which is contained in a hydrogen "treat gas," is provided to the reaction zone. Treat gas, as referred to in this disclosure, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), which will not adversely interfere with or affect either the reactions or the products. Unused or unreacted treat gas can be separated from the hydroprocessed product for re-use, generally after removing impurities, such as $H_2S$ and $NH_3$. Impurities, such as $H_2S$ and $NH_3$ are undesirable and would typically be largely removed from the treat gas before it is conducted to the reactor. The treat gas stream introduced into a reaction stage will preferably contain at least 50 vol. % and more preferably at least 75 vol. % hydrogen. Hydrogen can be supplied cocurrently with the heavy hydrocarbon oil and/or utility fluid or separately via a separate gas conduit to the hydroprocessing zone. The contact of the heavy hydrocarbon oil and utility fluid with the hydroprocessing catalyst and the hydrogen produces a total product that includes a hydroprocessed oil product, and, in some embodiments, gas.

Hydrogen can be supplied at a rate of from 300 SCF/B (standard cubic feet of hydrogen per barrel of feed) to 10,000 SCF/B (53 $Sm^3$/m3 to 1782 S3 $Sm^3/m^3$). Preferably, the hydrogen is provided in a range of from 1,000 SCF/B to 5,000 SCF/B (178 $Sm^3/m^3$ to 891 $Sm^3/m^3$.

Hydroprocessing

Hydroprocessing of the heavy hydrocarbon oil in the presence of the utility fluid can occur in one or more hydroprocessing stages, the stages comprising one or more hydroprocessing vessels or zones. Vessels and/or zones within the hydroprocessing stage in which catalytic hydroprocessing activity occurs generally include at least one hydroprocessing catalyst. The catalysts can be mixed or stacked, such as when the catalyst is in the form of one or more fixed beds in a vessel or hydroprocessing zone.

Conventional hydroprocessing catalyst can be utilized for hydroprocessing the heavy hydrocarbon oil in the presence of the utility fluid, such as those specified for use in residuum and/or heavy oil hydroprocessing, but the disclosure is not limited thereto. Suitable hydroprocessing catalysts include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In one or more embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst will contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts which further comprise inorganic oxides, e.g., as a binder and/or support, are within the scope of the disclosure. For example, the catalyst can comprise (i) ≥1.0 wt. % of one or more metals selected from Groups 6, 8, 9, and 10 of the Periodic Table and (ii) ≥1.0 wt. % of an inorganic oxide, the weight percents being based on the weight of the catalyst.

The disclosure encompasses incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, the support comprising at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" or "dried" catalysts. Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature >400° C. to form the hydroprocessing catalyst. Typically, such heat treating is conducted at temperatures ≤1200° C.

The catalyst can be in shaped forms, e.g., one or more of discs, pellets, extrudates, etc., though this is not required. Non-limiting examples of such shaped forms include those having a cylindrical symmetry with a diameter in the range of from 0.79 mm to 3.2 mm (1/32 to 1/8 inch), from 1.3 mm to 2.5 mm (1/20 to 1/10 inch), or from 1.3 mm to 1.6 mm (1/20 to 1/16 inch). Similarly-sized non-cylindrical shapes are within the scope of the disclosure, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the disclosure. When a porous catalyst is utilized, the catalyst can have a pore structure, pore size, pore volume, pore shape, pore surface area, etc., in ranges that are characteristic of conventional hydroprocessing catalysts, though the disclosure is not limited thereto. For example, the catalyst can have a median pore size in the range of from 30 Å to 1000 Å, or 50 Å to 500 Å, or 60 Å to 300 Å. Pore size can be determined according to ASTM Method D4284-07 Mercury Porosimetry.

In a particular embodiment, the hydroprocessing catalyst has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9 $cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area ≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Hydroprocessing the specified amounts of heavy hydrocarbon oil and utility fluid using the specified hydroprocessing catalyst leads to improved catalyst life, e.g., allowing the hydroprocessing stage to operate for at least 3 months, or at least 6 months, or at least 1 year without replacement of the catalyst in the hydroprocessing or contacting zone. Catalyst life is generally >10 times longer than would be the case if no utility fluid were utilized, e.g., ≥100 times longer, such as ≥1000 times longer.

The hydroprocessing is carried out in the presence of hydrogen, e.g., by (i) combining molecular hydrogen with the heavy hydrocarbon oil and/or utility fluid upstream of the hydroprocessing and/or (ii) conducting molecular hydrogen to the hydroprocessing stage in one or more conduits or lines.

Optionally, the amount of molecular hydrogen supplied to the hydroprocessing stage is in the range of from 300 SCF/B (standard cubic feet per barrel) (53 S $m^3/m^3$) to 5000 SCF/B (890 S $m^3/m^3$), in which B refers to barrel of the heavy hydrocarbon oil. For example, the molecular hydrogen can be provided in a range of from 1000 SCF/B (356 S $m^3/m^3$) to 3000 SCF/B (712 S $m^3/m^3$). Hydroprocessing the heavy hydrocarbon oil in the presence of the specified utility fluid, molecular hydrogen, and a catalytically effective amount of the specified hydroprocessing catalyst under catalytic hydroprocessing conditions produces a hydroprocessed product. An example of suitable catalytic hydroprocessing conditions will now be described in more detail. The disclosure is not limited to these conditions, and this description is not meant to foreclose other hydroprocessing conditions within the broader scope of the disclosure.

The hydroprocessing is generally carried out under hydroconversion conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, hydrovisbreaking or hydrodewaxing of the specified heavy hydrocarbon oil. The hydroprocessing reaction can be carried out in at least one vessel or zone that is located, e.g., within a hydroprocessing stage. The specified heavy hydrocarbon oil generally contacts the hydroprocessing catalyst in the vessel or zone, in the presence of the utility fluid and molecular hydrogen. Catalytic hydroprocessing conditions can include, e.g., exposing the combined utility fluid heavy hydrocarbon oil mixture to a temperature in the range from 50° C. to 500° C. or from 200° C. to 450° C. or from 220° C. to 430° C. or from 350° C. to 420° C. proximate to the molecular hydrogen and hydroprocessing catalyst. For example, a temperature in the range of from 300° C. to 500° C., or 350° C. to 430° C., or 360° C. to 420° C. can be utilized. Liquid hourly space velocity (LHSV) of the combined utility fluid heavy hydrocarbon oil mixture will generally range from $1.0^{-1}$ to 40 $h^{-1}$, or 2 $h^{-1}$ to 30 $h^{-1}$, or 4 $h^{-1}$ to 20 $h^{-1}$. In some embodiments, LHSV is at least 5 $h^{-1}$, or at least 10 $h^{-1}$, or at least 15 $h^{-1}$. Molecular hydrogen partial pressure during the hydroprocessing is generally in the range of from 0.1 MPa to 8 MPa, or 1 MPa to 7 MPa, or 2 MPa to 6 MPa, or 3 MPa to 5 MPa. In some embodiments, the partial pressure of molecular hydrogen is ≤7 MPa, or ≤6 MPa, or ≤5 MPa, or ≤4 MPa, or ≤3 MPa, or ≤2.5 MPa, or ≤2 MPa. The hydroprocessing conditions can include, e.g., one or more of a temperature in the range of 300° C. to 500° C., a pressure in the range of 15 bar (absolute) to 135 bar, a space velocity in the range of 1.0 to 40.0, and a molecular hydrogen consumption rate of 200 SCF/B to 1000 SCF/B (70 S $m^3/m^3$ to 356 S $m^3/m^3$ S $m^3/m^3$). In one or more embodiment, the hydroprocessing conditions include one or more of a temperature in the range of 380° C. to 430° C., a pressure in the range of 21 bar (absolute) to 81 bar (absolute), a space velocity in the range of 1.0 to 20.0. The hydrogen consumption rate will be 200 SCF/B to 1000 SCF/B (70 S $m^3/m^3$ to 356 S $m^3/m^3$ S $m^3/m^3$). More preferably the hydrogen consumption will be less than 500 SCF/B (178 S $m^3/m^3$ S $m^3/m^3$). When operated under these conditions using the specified catalyst, 1050° F.+ (566° C.+) conversion is generally ≥25.0% on a weight basis, e.g., ≥50.0%.

An embodiment of the disclosure is shown schematically in the FIGURE. The heavy hydrocarbon oil provided via conduit 1 and utility fluid provided by conduit 7 is conducted via conduit 8 to hydroprocessing stage 2 which includes a hydroprocessing reactor for hydroprocessing under one or more of the specified hydroprocessing conditions. Molecular hydrogen treat gas is conducted to hydroprocessing stage 2 by one or more conduits (not shown). The hydroprocessing stage effluent is conducted via conduit 3 to separation stage 4. The a portion of the hydroprocessing stage effluent's total liquid product is separated and conducted away from separation stage 4 via conduit 7 for use as the utility fluid. An offgas comprising, e.g., molecular hydrogen, methane, and hydrogen sulfide is separated from the reactor effluent in separation stage 4 and is conducted away via conduit 6. Following offgas separation, a hydroprocessed product comprising, e.g., $C_{5+}$ hydrocarbon is conducted away via conduit 5.

The following examples further describe aspects of certain embodiments of the disclosure. The disclosure is not limited to these examples, and these examples are not meant to foreclose other embodiments within the broader scope of the disclosure.

EXAMPLES

Example 1

A 56 cm length of ¼ inch stainless steel tubing is filled with 60-100 mesh washed sea sand, 10 $cm^3$ of sand is required to fill the tube. The middle 35 cm of tubing is held at near isothermal conditions during the run. The volume inside the hot zone is 6 $cm^3$. 2000 $cm^3$ of a complex feedstock is prepared. Half the feedstock is comprised of processed bitumen containing 30 wt. % 1-MN derived utility fluid. 35% of the feedstock is unprocessed paraffin froth treated Athabasca bitumen. 15% of the feedstock is 1-methylnaphthalene (1-MN). The blended feedstock is 21 wt. % 1050° F.+ (21 wt. % vacuum residuum). The feedstock is pumped into the unit at 14 $cm^3$/hr. Hydrogen is metered into the unit at 220 $Scm^3$/min. The reactor pressure is maintained at 800 psig, and temperature at 438° C.

It takes 5 days to pump the full 1600 $cm^3$ of feed through the reactor. During the 5 days, the pressure drop across the reactor increased from 20 psi to 200 psi. A second batch of feed is prepared by blending the first 1500 $cm^3$ of liquid product with 15 wt. % fresh Athabasca bitumen. Changing the feed led to operation with a steady pressure drop of 200 psi for 3 days. At this point, the liquid product from the second batch is back blended with the first batch. In effect, this produced a third batch of feed that is 8 wt. % fresh Athabasca bitumen, and 92 wt. % hydroprocessed visbroken liquids. As this feed is processed from days 9 to 14, the pressure drop across the reactor declined from 200 psi to as low as 30 psi. 92% product liquids with 8% fresh Athabasca bitumen were used as feedstock for the remainder of the run. Product is withdrawn to keep the total circulating feed at 2000 $cm^3$. At 45 days the pressure drop reaches 400 psi and the run is terminated.

The initial feed to the run is 35% Athabasca bitumen/65% utility fluids (700 g/1300 g), corresponding to a utility fluid: heavy hydrocarbon weight ratio of 1.86. During the course of the run, 8 wt. % fresh bitumen (160 g) is added 9 times. So the total feed is 2140 g bitumen plus 1300 g utility fluids. At the end of the run, 1-MN derived utility fluid had been reduced to 15% of the composition because of the regular product purging required to keep the amount of feedstock at a constant 2000 $cm^3$. The utility fluid is inert at these conditions. The product at the end of the run is usefully compared to the feed bitumen.

TABLE 1

| | Athabasca Bitumen Feed | Product |
|---|---|---|
| $H_2S$ | — | 1.2 |
| $C_1$-$C_4$ | 0 | 4 |
| $C_4$-150° C. | 0 | 8 |
| 150-350° C. | 18 | 30 |
| 350-565° C. | 44 | 39 |
| 565+° C. | 38 | 18 |
| Total | 100 | 100.2 |

Example 1 is simulating a process where Athabasca bitumen is the only feedstock. The fresh feed plus recycle is hydroprocessed across a bed of sand. Table 1 above shows the expected yields. Example 1 only ran long enough for the bitumen derived products to displace 50% of the original utility fluid meaning that steady state was not achieved.

Rapid fouling across a sand bed is expected with this type of feed, as only tiny quantities of coke are required to plug a bed of fine sand (60-100 mesh). The run operated at relatively high LHSV with diluted feedstock. The utility fluid was a special combination of pre-processed Athabasca bitumen and 1-MN. A significant amount and concentration of Athabasca bitumen went through a bed of sand at 438° C. and was converted without rapid fouling.

By steady state, the inventors mean continue the run long enough so that >95% of the total feed was bitumen plus recycled product, and <5% was the initial batch of utility fluid. Such a result would demonstrate almost >50% 1050+ conversion without forming coke or toluene insolubles.

Example 2

An experiment was designed adding surface area and catalytic activity to improve process stability in order to achieve steady-state conversion of bitumen at 55% 1050° F.+ conversion.

Hydroprocessing conditions in reactor 2 include a pressure of approximately 70 bar (800 psig), a temperature of 430° C., a molecular hydrogen feed rate of 140 $Sm^3/m^3$ (750 SCFB) on a feedstock basis, and a space velocity (LHSV) of 12.5 $hr^{-1}$ for the feedstock bitumen plus recycle (utility fluid). The reactor effluent comprises a vapor phase and a liquid phase, the liquid phase being the total liquid product. The amount of total liquid product is approximately 95.0 wt. % of the total liquid feed to the reactor.

A 56 cm length of ¼ inch stainless steel tubing is used as a reactor. The middle 34 cm is held at a near-isothermal temperature of 430° C. during the course of the experiment. The volume of the hot zone is 6.2 $cm^3$. The 6.2 $cm^3$ hot zone is loaded with 77.4 vol. % 80 mesh silica (4.8 $cm^3$) and 22.6 vol. % of a commercial NiMo oxide on alumina hydrotreating catalyst (1.4 $cm^3$). The cold zones were filled with 80 mesh silica.

The feedstock to the reactor is 15 wt. % paraffin froth treated Athabasca bitumen, 0.75 wt. % partially hydrogenated 1-methylnaphthalenes (d.=0.960), and 84.25 wt. % total liquid product e.g. recycled utility fluid. This corresponds to a utility fluid:heavy hydrocarbon weight ratio of 5.67 The feedstock flowrate is 21 $cm^3$/hr accompanied by 46 $Scm^3$/min. of hydrogen (700 SCF/B). The reactor pressure is 800 psig and the reactor temperature is 430° C. The paraffin froth treated Athabasca bitumen is 4.5 wt. % S, 163 ppm V, 62 ppm Ni, 15 wt. % distillate, 43 wt. % VGO, and 42 wt. % 1050° F.+. The density is 1.01 g/$cm^3$.

Example 2 achieved 55% 1050° F.+ conversion, plus 55% demetallation, and 55% hydrodesulfurization. The hydrogen consumption is only 400 SCFB. NMR analysis of the feed (95 wt. % bitumen/5 wt. % partially hydrogenated 1-methylnaphthalene) and the product showed no change in aromatic carbon content within experimental error. The feed is 26 wt. % aromatic carbon. The total liquid product is 29 wt. % aromatic carbon. Since the liquid product is 92% of the total product (8 wt. % left the unit in the gas phase), the total product is also 26% aromatic carbon (because the hydrocarbon gas is essentially 0% aromatic carbon). Examples 2 operates at 2.25 $hr^{-1}$ LHSV on the Athabasca bitumen and 12.5 $hr^{-1}$ for the feedstock bitumen plus recycle utility fluid. After 14 days the recycle ratio is doubled. The run operated at the higher recycle ratio for another 14 days. In total, the run processed 1200 volumes of feed per volume of catalyst and deposited close to 25 wt. % Ni+V on the catalyst. After 28 days the run is terminated because of high pressure drop across the reactor.

Example 2 provides proof of a low cost method to process bitumen. The example operates in a fixed bed at medium pressure and at an extraordinarily high 1050° F.+ conversion productivity. Example 2 also demonstrates an effective method to sufficiently reduce the viscosity of bitumen to meet pipeline specifications. The total liquid product from Example 2 at the end of the run had a viscosity of 64 cSt at 40° C. and 7.8 cSt at 100° C. These are within the normal range for pipeline transport.

Example 2 demonstrates that Athabasca bitumen can be hydrovisbroken to an easily pumped liquid (meets pipe line specifications) using low surface area, low activity demetallation hydrotreating catalysts in a packed bed with minimal hydrogen consumption. The example suggests that this can be accomplished using Athabasca bitumen and hydrogen as the only raw materials. Product recycle, augmented by distillation and recycle of a small amount of kerosene range material is all that is required to carry out the process of the disclosure.

PCT/EP Clauses:

1. A hydrocarbon conversion process, comprising: (a) providing a heavy hydrocarbon oil wherein the heavy hydrocarbon oil comprises molecules having an ASTM D86 initial boiling point of ≥300° C.; (b) providing a utility fluid, the utility fluid comprising ≥20.0 wt. % aromatic carbon based on the weight of the utility fluid; (c) exposing at least a portion of the heavy hydrocarbon oil to at least one hydroprocessing catalyst under catalytic hydroprocessing conditions in the presence of molecular hydrogen and the utility fluid at a utility fluid:heavy hydrocarbon weight ratio in the range of 0.05 to 20.0 to produce a hydroprocessed product; and (d) separating a liquid phase from the hydroprocessed product, the liquid phase comprising ≥90.0 wt. % of the hydroprocessed product's molecules having at least four carbon atoms based on the weight of the hydroprocessed product wherein the utility fluid comprises the liquid phase in an amount ≥90.0 wt. % based on the weight of the utility fluid.

2. The process of clause 1, wherein the heavy hydrocarbon oil is selected form the group consisting of heavy crude oils, atmospheric residuum, vacuum residuum, heavy oils from catalytic treatment, heavy cycle oils from fluid catalytic cracking, thermal tars, as oils from visbreaking, oils from oil sands, bitumen, deasphlter rock, and heavy oils derived from coal.

3. The process of clause 1 or 2, wherein the heavy hydrocarbon oil further comprises greater than 25 wt. % 566° C.+, greater than 1.5 wt. % heteroatom content, and greater than 15% $C_A$ 4. The process of clauses 1 or 2, wherein the utility fluid comprises ≥30.0 wt. % aromatic carbon measured by NMR based on the weight of the utility fluid.

5. The process of clauses 1-3, wherein the liquid phase comprises ≥90.0 wt. % of the hydroprocessed product's molecules having an atmospheric boiling point ≥65.0° C. based on the weight of the hydroprocessed product.

6. The process of any of clauses 1-4, wherein the liquid phase comprises ≥90.0 wt. % of the hydroprocessed product's molecules having an atmospheric boiling point ≥150.0° C. based on the weight of the hydroprocessed product.

7. The process of any of clauses 1-5, wherein the liquid phase comprises ≥90.0 wt. % of the hydroprocessed product's molecules having an atmospheric boiling point ≥260.0° C. based on the weight of the hydroprocessed product.

8. The process of any of clauses 1-6, wherein the density of the utility fluid at 15° C. is less than the density of the heavy hydrocarbon oil at 15° C.

9. The process of any of clauses 1-7, wherein the hydroprocessing conditions include one or more of a temperature in the range of 380° C. to 430° C., a pressure in the range of 21 bar to 81 bar, a space velocity (LHSV) in the range of 1.0 to 40.0 $hr^{-1}$, and a hydrogen consumption rate of 200 SCF/B to 1000 SCF/B 10. The process of any of clauses 1-8, wherein the utility fluid:heavy hydrocarbon oil weight ratio of step (e) is in the range of 0.1 to 2.0.

11. The process of any of clauses 1-10, further comprising conducting a second portion of the liquid phase away from the process.

12. The process of any of clauses 1-11, further comprising providing a supplemental utility fluid to step (d) to replace at least a part of the utility fluid from a portion of the liquid phase in step (g), the supplemental utility fluid comprising aromatics and having an ASTM D86 10% distillation point ≥60.0° C. and a 90% distillation point ≤350.0° C.

13. A hydrocarbon conversion process, comprising: (a) providing a heavy hydrocarbon oil comprising molecules having an ASTM D86 initial boiling point of ≥300° C.; (a) providing a utility fluid, the utility fluid comprising ≥20.0 wt. % aromatic carbon measured by NMR based on the weight of the utility fluid; (b) exposing at least a portion of the heavy hydrocarbon oil to at least one hydroprocessing catalyst under catalytic hydroprocessing conditions in the presence of molecular hydrogen and the utility fluid at a utility fluid: heavy hydrocarbon oil weight ratio in the range of 0.05 to 20.0 to produce a hydroprocessed product; (c) separating a liquid phase from the hydroprocessed product, the liquid phase comprising ≥90.0 wt. % of the hydroprocessed product's molecules having at least four carbon atoms based on the weight of the hydroprocessed product; and (d) separating from the liquid phase a light liquid and a heavy liquid, wherein the heavy liquid comprises 90 wt. % of the liquid phase's molecules having an atmospheric boiling point of ≥300° C.; wherein the utility fluid comprises a portion of the separated light liquid in an amount ≥10.0 wt. % based on the weight of the utility fluid and the remainder of the utility fluid comprises a portion of the heavy liquid.

14. The process of clause 13 wherein the liquid phase comprises ≥90.0 wt. % of the hydroprocessed product's molecules having an atmospheric boiling point ≥65.0° C. based on the weight of the hydroprocessed product.

15. The process of clauses 13 or 14, wherein the liquid phase comprises ≥90.0 wt. % of the hydroprocessed product's molecules having an atmospheric boiling point ≥150.0° C. based on the weight of the hydroprocessed product.

16. The process of claim any of clauses 13-15, wherein the liquid phase comprises ≥90.0 wt. % of the hydroprocessed product's molecules having an atmospheric boiling point ≥260.0° C. based on the weight of the hydroprocessed product.

17. The process of any of clauses 13-16, wherein the heavy liquid comprises 90.0 wt. % of the liquid phase's molecules having an atmospheric boiling point of ≥250° C.

18. The process of any of clauses 13-17, wherein the heavy liquid comprises 90.0 wt. % of the liquid phase's molecules having an atmospheric boiling point of ≥350° C.

19. The process of any of clauses 13-18, further comprising conducting a second portion of the light liquid away from the process.

20. A continuous hydrocarbon conversion process, comprising: (a) providing a heavy hydrocarbon oil comprising molecules having an ASTM D86 initial boiling point of ≥300° C.; (b) providing a utility fluid, the utility fluid comprising ≥20.0 wt. % aromatic carbon measured by NMR based on the weight of the utility fluid; (c) exposing ≥50.0 wt. % of the heavy hydrocarbon oil based on the weight of the second mixture's heavy hydrocarbon to at least one hydroprocessing catalyst under catalytic hydroprocessing conditions operating continuously for a time ≥24 hours, in the presence of the utility fluid and 50.0 $sm^3/m^3$ to 500.0 $sm^3/m^3$ molecular hydrogen at (i) an LHSV in the range of from 1.0 to 40.0 $hr^{-1}$, (ii) a temperature in the range of 300.0° C. to 500.0° C., (iii) a pressure in the range of from 25 bar (absolute) to 75 bar (absolute), and (iv) a utility fluid:heavy hydrocarbon oil weight ratio in the range of 0.05 to 20.0, to produce a hydroprocessed product; and (d) separating a liquid phase from the hydroprocessed product, the liquid phase comprising ≥95.0 wt. % of the hydroprocessed product's molecules having at least four carbon atoms based on the weight of the hydroprocessed product; wherein the utility fluid comprises the separated liquid phase in an amount ≥99.0 wt. % based on the weight of the utility fluid.

21. The continuous hydrocarbon conversion process of clause 20, wherein the pressure drop across the exposing step (c) does not exceed the initial pressure drop by more than 200% after the 45 days of continuous operation.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A hydrocarbon conversion process, comprising:

(a) providing a heavy hydrocarbon oil wherein the heavy hydrocarbon oil comprises molecules having an ASTM D86 initial boiling point of ≥300° C. and at least 50 ppmw Ni/V/Fe;

(b) providing a utility fluid, the utility fluid comprising ≥20.0 wt. % aromatic carbon based on the weight of the utility fluid;

(c) exposing at least a portion of the heavy hydrocarbon oil to at least one hydroprocessing catalyst under catalytic hydroprocessing conditions in the presence of molecular hydrogen and the utility fluid at (i) an LHSV in the range of from 1.0 to 40.0 $hr^{-1}$, (ii ) a temperature in the range of 300.0° C. to 500.0° C.,(iii) a pressure in the range of from 25 bar (absolute) to 75 bar (absolute), and at a utility fluid: heavy hydrocarbon weight ratio in the range of 0.05 to 20.0 to produce a hydroprocessed product; and (d) separating a liquid phase from the hydroprocessed product, the liquid phase comprising ≥90.0 wt. % of the hydroprocessed product's molecules having at least four carbon atoms based on the weight of the hydroprocessed product wherein the utility fluid comprises the liquid phase in an amount ≥90.0 wt. % based on the weight of the utility fluid.

2. The process of claim 1, wherein the heavy hydrocarbon oil is selected form the group consisting of heavy crude oils, atmospheric residuum, vacuum residuum, heavy oils from catalytic treatment, heavy cycle oils from fluid catalytic cracking, oils from oil sands, bitumen, deasphlter rock, and heavy oils derived from coal.

3. The process of claim 1 or 2, wherein the heavy hydrocarbon oil further comprises greater than 25 wt.% 566°C.+, greater than 1.5 wt. % heteroatom content, and greater than 15% $C_A$.

4. The process of claim 1, wherein the utility fluid comprises ≥30.0 wt. % aromatic carbon measured by NMR based on the weight of the utility fluid.

5. The process of claim 1, wherein the liquid phase comprises ≥90.0 wt. % of the hydroprocessed product's molecules having an atmospheric boiling point ≥65.0° C. based on the weight of the hydroprocessed product.

6. The process of claim 1, wherein the liquid phase comprises ≥90.0 wt. % of the hydroprocessed product's molecules having an atmospheric boiling point ≥150.0° C. based on the weight of the hydroprocessed product.

7. The process of claim 1, wherein the liquid phase comprises ≥90.0 wt. % of the hydroprocessed product's molecules having an atmospheric boiling point ≥260.0° C. based on the weight of the hydroprocessed product.

8. The process of claim 1, wherein the density of the utility fluid at 15° C. is less than the density of the heavy hydrocarbon oil at 15° C.

9. The process of claim 1, wherein the hydroprocessing conditions include one or more of a temperature in the range of 380° C. to 430° C., a pressure in the range of 21 bar to 81 bar, a space velocity (LHSV) in the range of 1.0 to 40.0 $hr^{-1}$, and a hydrogen consumption rate of 200 SCF/B to 1000 SCF/B.

10. The process of claim 1, wherein the utility fluid:heavy hydrocarbon oil weight ratio of step (c) is in the range of 0.1 to 2.0.

11. The process of claim 1, further comprising conducting a second portion of the liquid phase away from the process.

12. The process of claim 1, further comprising (c) providing a supplemental utility fluid to step (c) to replace at least a part of the utility fluid from a portion of the liquid phase in step (d), the supplemental utility fluid comprising aromatics and having an ASTM D86 10% distillation point ≥60.0° C. and a 90% distillation point ≤350.0° C.

13. A continuous hydrocarbon conversion process, comprising:

(a) providing a heavy hydrocarbon oil comprising molecules having an ASTM D86initial boiling point of ≥300° C. and at least 50 ppmw Ni/V/Fe;

(b) providing a utility fluid, the utility fluid comprising ≥20.0 wt. % aromatic carbon measured by NMR based on the weight of the utility fluid;

(c) exposing ≥50.0 wt. % of the heavy hydrocarbon oil based on the weight of the second mixture's heavy hydrocarbon to at least one hydroprocessing catalyst under catalytic hydroprocessing conditions operating continuously for a time ≥24 hours, in the presence of the utility fluid and 50.0 $sm^3/m^3$ to 500.0 $sm^3/m^3$ molecular hydrogen at (i) an LHSV in the range of from 1.0 to 40.0 $hr^{-1}$, (ii) a temperature in the range of 300.0° C. to 500.0° C., (iii) a pressure in the range of from 25 bar (absolute) to 75 bar (absolute), and (iv) a utility fluid: heavy hydrocarbon oil weight ratio in the range of 0.05 to 20.0, to produce a hydroprocessed product; and (d) separating a liquid phase from the hydroprocessed product, the liquid phase comprising ≥95.0 wt. % of the hydroprocessed product's molecules having at least four carbon atoms based on the weight of the hydroprocessed product;

wherein the utility fluid comprises the separated liquid phase in an amount ≥99.0 wt. % based on the weight of the utility fluid.

14. The continuous hydrocarbon conversion process of claim 13, wherein the pressure drop across the exposing step (c) does not exceed the initial pressure drop by more than 200% after the 45 days of continuous operation.

* * * * *